US006366749B1

(12) United States Patent
Koumoto

(10) Patent No.: US 6,366,749 B1
(45) Date of Patent: Apr. 2, 2002

(54) PROCESS CARTRIDGE AND IMAGE FORMING APPARATUS USING THE SAME

(75) Inventor: Mitsuhiro Koumoto, Utsunomiya (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/661,803

(22) Filed: Sep. 14, 2000

(30) Foreign Application Priority Data

Feb. 9, 2000 (JP) ..... 12-031352

(51) Int. Cl.[7] ..... G03G 21/18; G03G 21/16
(52) U.S. Cl. ..... 399/113; 399/111
(58) Field of Search ..... 399/107, 110, 399/111, 113, 116, 117

(56) References Cited

U.S. PATENT DOCUMENTS 4,841,330 A * 6/1989 Owada et al. ..... 399/119
4,845,523 A * 7/1989 Miyaji ..... 399/113
4,952,989 A * 8/1990 Kawano et al. ..... 399/113
5,019,867 A * 5/1991 Yamakawa et al. ..... 399/119
5,045,885 A * 9/1991 Nishio ..... 399/119 X
5,089,849 A * 2/1992 Hiraoka ..... 399/119
5,414,493 A * 5/1995 Fujii et al. ..... 399/199 X

* cited by examiner

*Primary Examiner*—Sandra Brase
(74) *Attorney, Agent, or Firm*—Greenblum & Bernstein, P.L.C.

(57) ABSTRACT

A process cartridge of the present invention is separable into a first unit 105 including a photosensitive roller 108 and a second unit 106 including a development roller 109. The second unit 106 is provided with an operation member 320 which is capable of moving in a unit inserting/drawing out direction. When the operation member is thrust in the unit inserting direction, the second unit 106 is pressed against the first unit 105. When the operation member is pulled to the unit drawing out direction, the pressing of the second unit 106 against the first unit 105 is released.

8 Claims, 8 Drawing Sheets

PROCESS CARTRIDGE AND IMAGE FORMING APPARATUS USING THE SAME

BACKGROUND OF THE INVENTION

1. Field of the Invention

The present invention relates generally to a process cartridge in which development associated members such as a development roller are made as a unit, and more particularly, to a process cartridge having an improved detachability operability and to an image forming apparatus using the same.

2. Description of the Related Art

Conventionally, in this type of image forming apparatus, elements or components for use in image formation such as a toner hopper, a development roller, a photoreceptor and an electrification part are replaceably accommodated in a unified process cartridge. If a toner within the toner hopper in the process cartridge runs short, a new process cartridge is inserted for use.

However, such prior art has entailed problems which follow.

That is, the elements constituting the process cartridge do not have the same life, and hence the live of the entire process cartridge is designed to conform to that of the part having the shortest life. Even if still serviceable elements remained in this process cartridge, the entire of the process cartridge including these elements had to be replaced with a new one. For example, the life of the development roller is about 5,000 sheets of record paper, whereas the life of the photoreceptor is about 30,000 sheets of record paper. For this reason, the process cartridge is replaced with a new one at the time when the development roller comes to an end of the life, and therefore the still serviceable photoreceptor is also replaced together with the development roller. Since the still serviceable elements had also to be replaced with a new one in the prior art in this manner, effective utilization of resources is not achieved with economical burden upon users more than needed.

It is possible to solve such a drawback by separating the process cartridge into a plurality of units based on respective elements or components so that only necessary units can be replaced with new ones in compliance with the lives of the respective elements.

However, such means has caused another problem which follow.

That is, in the case where such a structure is adopted that the process cartridge can be separated into the plurality of units, a unit replacement of the development roller having shorter life than the other elements frequently occurs as compared with a unit replacement of the photoreceptor having relatively long life. On the other hand, it is necessary to retain an interval between the development roller and the photoreceptor at a predetermined distance in order to maintain image quality. For this reason, the unit of the development roller inside the apparatus must be in a state of press contact with the unit of the photoreceptor. However, if the development roller unit undergoes the mounting or dismounting while being in press contact with the photoreceptor unit, operability will markedly be impaired when the development roller unit is inserted into or drown out from an apparatus main body. On the contrary, in order to ensure the operability upon the inserting or drawing out of the development roller relative to the apparatus main body, if an arrangement is employed in which the development roller unit can be mounted on or dismounted from the photoreceptor unit with a margin, it is difficult to put the development roller unit in a state of coming into press contact with the photoreceptor unit inside the apparatus. Thus, the quality of images to be developed may become degraded.

SUMMARY OF THE INVENTION

It is an object of the present invention to provide a process cartridge and an image forming apparatus using the same, the process cartridge being separated into a plurality of units depending on the lives of constituent elements so that required elements can be replaced with new ones, to thereby achieve an effective utilization of resources with reduced economic burdens on users, the process cartridge even though the development roller and the photoreceptor are separately accommodated in different units, ensuring a smooth inserting/drawing out operation of the development roller unit and assuring an appropriate distance between the development roller and the photoreceptor inside the apparatus.

According to an aspect of the present invention, the process cartridge is separated into a first unit including the photoreceptor and a second unit including the development roller, the second unit being provided with an operation member capable of moving in a unit inserting/drawing out direction, wherein when the operation member is thrust in the direction to mount the unit, the second unit is pressed against the first unit, and wherein when the operation member is drawn out to the unit dismounting direction, pressing of the second unit against the first unit is released.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

Hereinafter, an image forming apparatus according to an embodiment of the present invention will be described with reference to the accompanying drawings.

Figure 1:
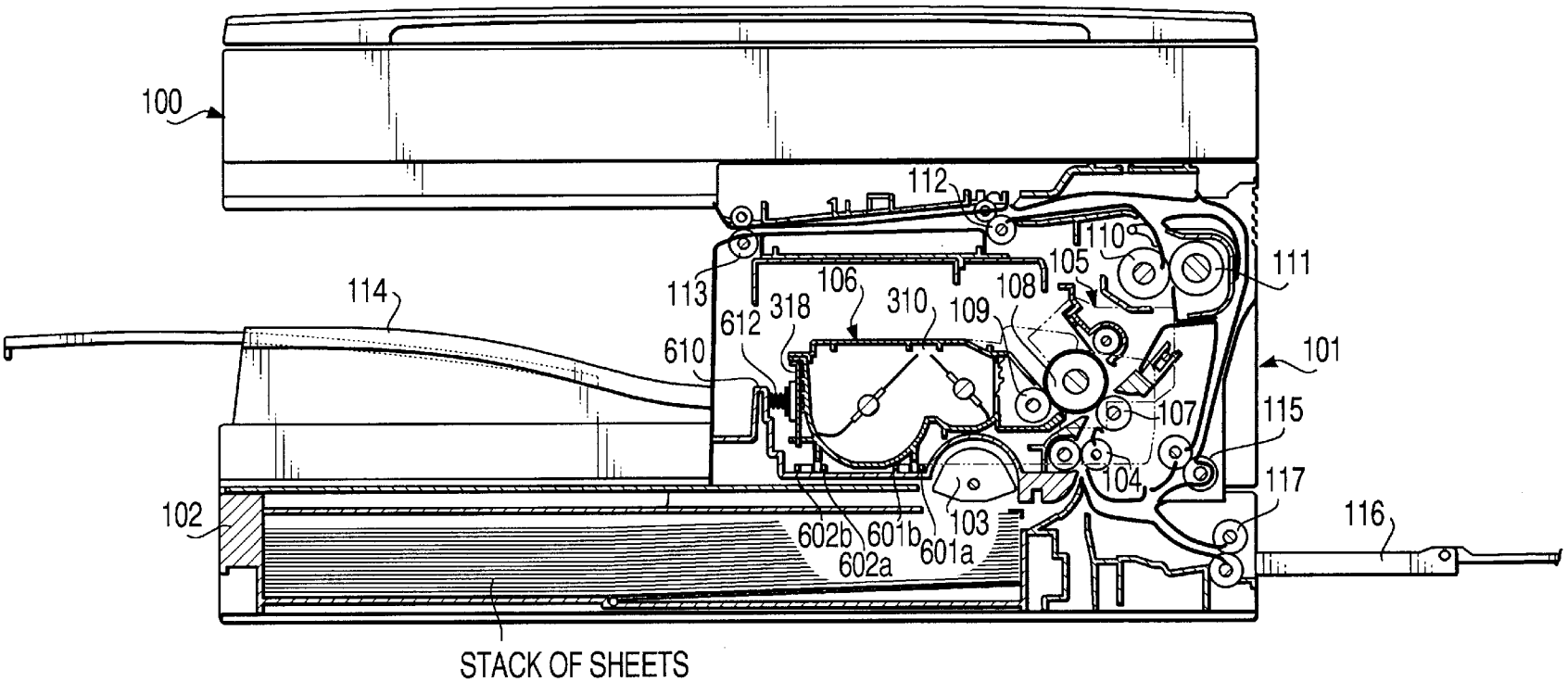
FIG. 1 is an overall structural view of an image forming apparatus according to an embodiment of the present invention.

FIG. 1 is a side view of the entire of the image forming apparatus according to this embodiment. This image forming apparatus records on record sheets image data read out by a scanner part 100 provided in an upper part of the apparatus or printing data received from an external unit by means of a record part 101 described below.

A paper feeding cassette 102 for accommodating a stack of sheets is detachably stored in a bottom part of an apparatus main body. The record sheets accommodated in the paper feeding cassette 102 are drawn out to a conveyance passage by a paper feeding roller 103. The paper feeding roller 103 feeds out the record sheets drawn out from the paper feeding cassette 102 to a pair of resist rollers 104 arranged in the conveyance passage. The resist roller 104 controls a timing when a record start position of a photoreceptor and a record start position of the record sheet are coincident with each other.

On the other hand, there is formed, at a center part of the record part 101, an accommodation part for accommodating a process cartridge which is separated into a first unit 105 having the photoreceptor and a second unit 106 having a development roller. The first unit 105 is detachably retained by the apparatus main body so that a photosensitive roller 108 serving as a photoreceptor is brought into contact with a transfer roller 107 fixed to an apparatus main body side. The second unit 106 is detachably retained by the apparatus main body in a state that a toner layer brings a development roller 109 formed on a surface of the roller into contact with the photosensitive roller 108.

In this manner, the first unit 105 and second unit 106 constituting the process cartridge can be inserted into or drown out from the apparatus main body, separately. Thus, the process cartridge is separated into the first and second units 105, 106 in response to the lives of the photosensitive roller 108 and the development roller 109 constituting the process cartridge, whereby if not the entire of the process cartridge, but only units including the photosensitive roller 108 or development roller 109 reaching an end of the lives are replaced with new ones, it becomes possible to continuously print images. As this result, it is possible to prevent resources from being consumed wastefully, and also to decrease circumstances that an economical burden is cast upon users more than needed.

The photosensitive roller 108 is exposed from an optical unit not shown to form a latent image, and a toner image in response to the latent image is formed on the surface. In this connection, this embodiment will be described by use of the photosensitive roller 108 as a photoreceptor, but a photoreceptor not taking a roller form may be used.

In a state that a voltage having inverse polarity to the toner image formed in the photosensitive roller 108 is applied on the transfer roller 107, the transfer roller 107 presses the record sheet against the photosensitive roller 108, whereby the toner image on the photoreceptor 108 is printed onto the record sheet.

The record sheet on which the toner image is printed is fed into a fixing unit in which a fixing roller 110 and a pressurizing roller 111 are arranged counter to each other, by a rotation of the transfer roller 107. When the record sheet passes between the pressurizing roller 111 and the fixing roller 110, it is pressed by both the rollers, and also heat is applied thereon by the fixing roller 110, whereby the toner on the record sheet is fixed to the record sheet. The record sheet on which the toner is fixed is discharged to a discharged paper reception part 114 by way of an intermediate discharge roller 112 and a discharge roller 113.

Furthermore, this image forming apparatus comprises a both-face printing function. By reversely rotating the intermediate discharge roller 112 and discharge roller 113, the record sheets fed to between the intermediate discharge roller 112 and discharge roller 113 are conveyed in reverse direction. This structure is so made that they feed the record sheets to a reversal roller 115 through the conveyance passage formed in an outer periphery of the record part 101, and again feeds them to the resist roller 104 therefrom.

Furthermore, a manual tray 116 is provided on a side face of the apparatus main body. The record sheets arranged in the manual tray 116 are fed to the resist roller 104 by a manual paper feeding roller 117, and pass through the aforesaid route to record images.

Figure 2:
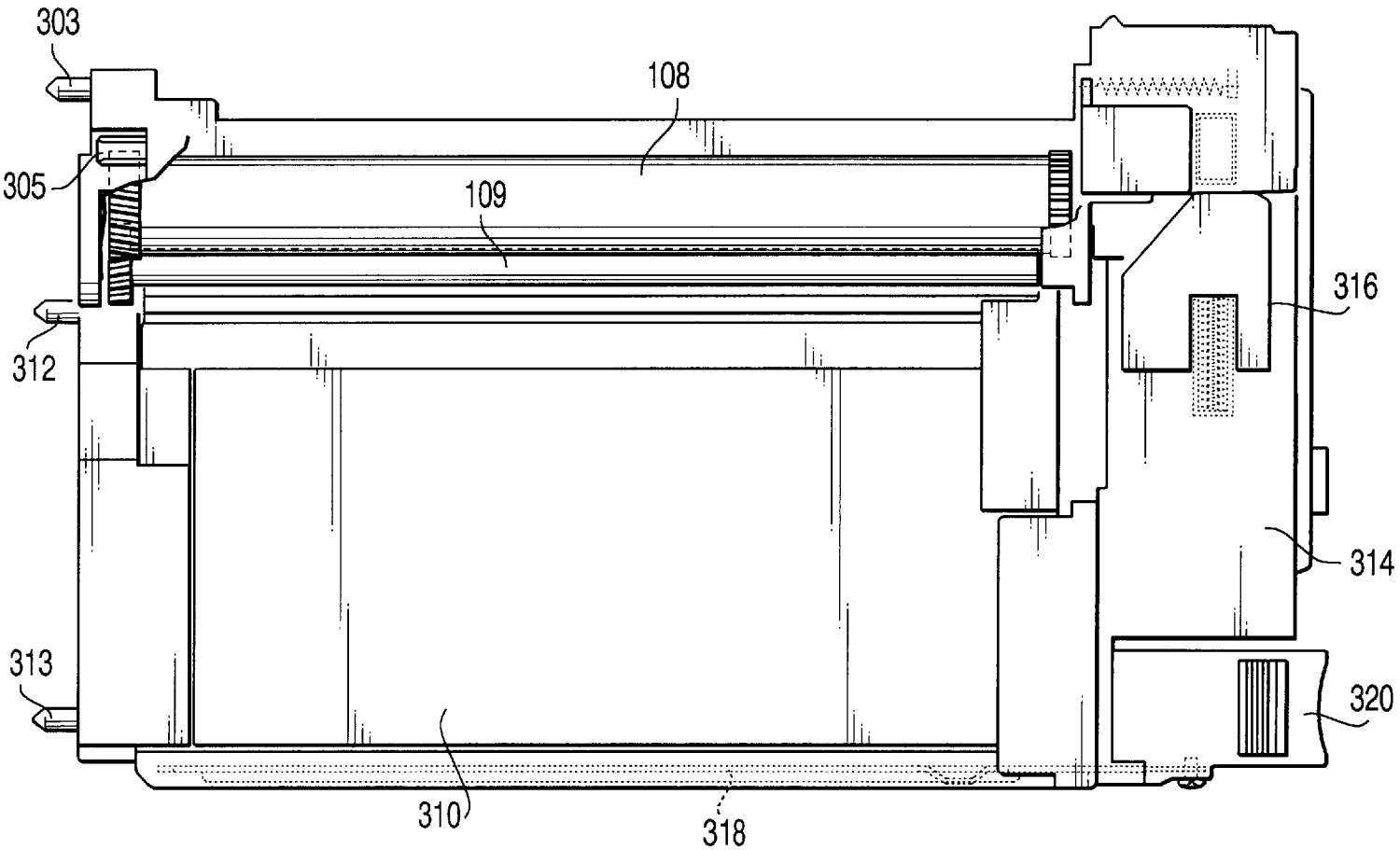
FIG. 2 is a top view of a process cartridge to be inserted into the image forming apparatus according to the embodiment of the present invention.
Figure 3A:
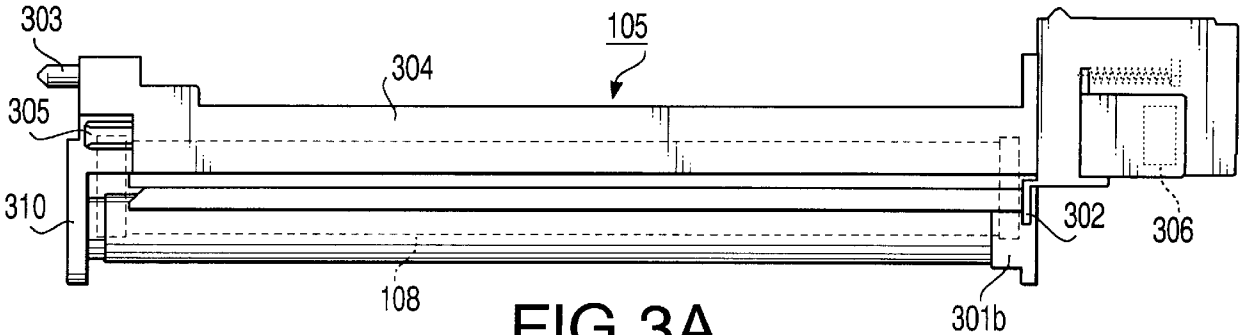
FIG. 3A is a top view of a first unit constituting the process cartridge according to the embodiment of the present invention.
Figure 3B:
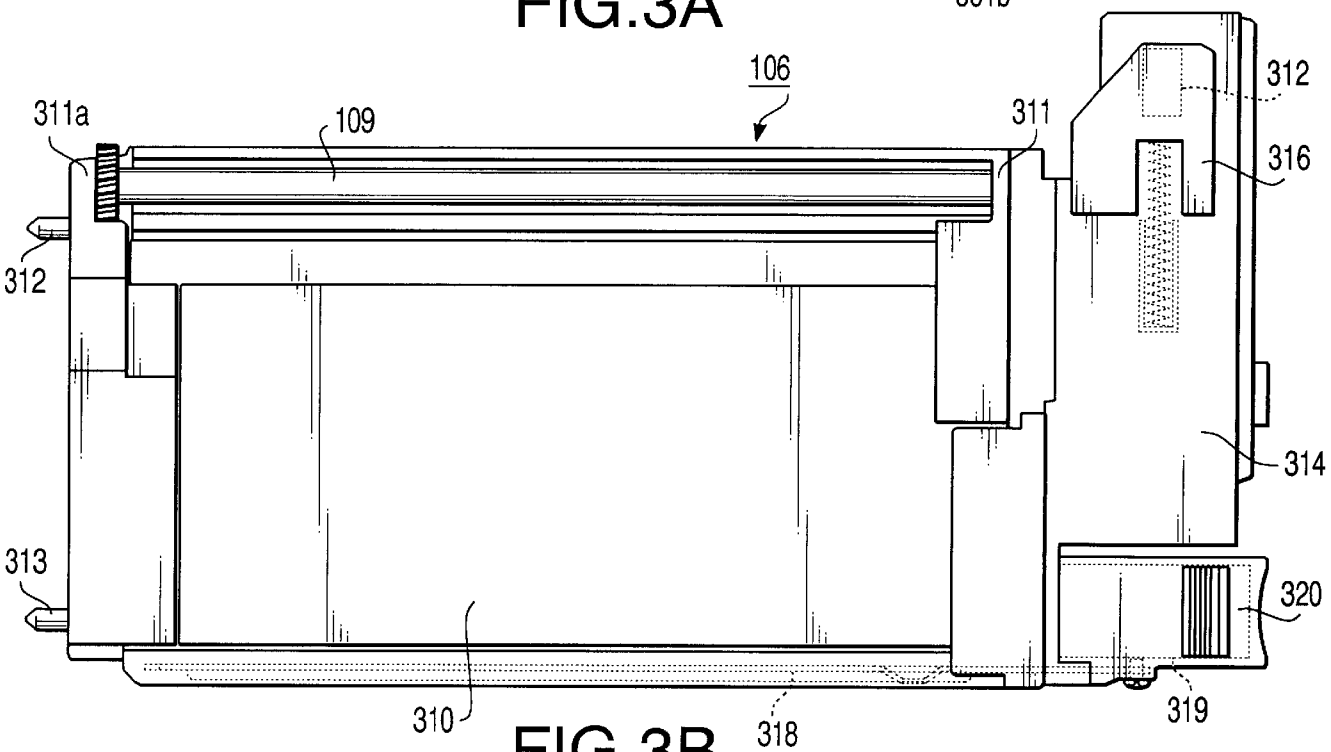
FIG. 3B is a top view of a second unit constituting the process cartridge according to the embodiment of the present invention.

Here, a structure of the process cartridge constituted by the first unit 105 and second unit 106 will be described. FIG. 2 is a top view of both first and second units 105, 106 in a state that they are both inserted into the accommodation part of the apparatus main body, and FIG. 3A is a top view of the first unit 105, and FIG. 3B is a top view of the second unit 106.

A pair of retaining plates 301*a*, 301*b* is integrally formed at both ends in a longitudinal direction of the first unit 105 so that the first unit 105 rotatably retains both the ends of the photosensitive roller 108. There is provided an L-shaped fitting member 302 to be hooked by a stop part at an apparatus main body side on an upper face of the first unit 105, and there is provided a projection 303 which is inserted into a positioning hole, which is provided at a corresponding position of the apparatus main body, on an end surface at an insert side of the first unit 105. An unnecessary toner adhered to a surface of the photosensitive roller 108 is chipped off by a blade not shown. An discharged toner passage 304 for discharging a discharged toner chipped off is provided the photosensitive roller 108 side by side. An discharged toner screw for feeding the discharged toner in a direction where a discharged toner box is Inserted into the interior of the discharged toner passage 304. Reference numeral 305 denotes a rotational shape of the discharged toner screw.

There is formed a toner discharge outlet 306 for feeding the fed discharged toner to the discharged toner box at one end of the discharged toner passage 304.

The fitting member 302 formed on an upper face of the first unit 105 is hooked by the stop part at an apparatus main body side ,and then is pushed in the first unit 105 as it is to a horizontal direction, whereby the fitting member 302 slides on the stop part, and the first unit 105 is inserted into the accommodation part of the apparatus main body.

Furthermore, the projection 303 is inserted into the positioning hole, thereby positioning the first unit 105.

In the second unit 106, a toner box 310 in the interior of which the toner is accommodated is incorporated into a unit main body. In the second unit 106, the development roller 109 is arranged at a side confronted to the first unit 105 (hereinafter called a front side). At both ends of the second unit 106 are both the ends of the development roller 109 rotatably retained by a pair of retaining plates 311*a*, 311*b* projecting at a side of the first unit 105. There are provided protrusions 312, 313 which are inserted into positioning holes, which are provided at corresponding positions of the apparatus main body, on an end face in an insert direction in the second unit 106. In this connection, after the second unit 106 is inserted into the accommodation part of the apparatus main body, as it moves to a direction of the first unit 105 at a predetermined distance, the positioning hole of the apparatus main body is supposed to be in an oval shape extending long to a direction of the first unit 105. At an end at a side opposite to an insert side of the second unit 106 is a discharged toner box 314 provided. On an upper face of the discharged toner box 314 is a discharged toner inlet 315 formed at a position counter to the toner discharge outlet 306 of the first unit 105. A slider 316 is urged to a direction of clogging the discharge toner inlet 315 in a state that the first unit 105 is a unit simple, and when it is combined with the first unit 105, the first unit 105 is pressed against a tapering face 317 of the slider 316 to push up the slider 316, so that the discharged toner inlet 315 is matched with the toner discharge outlet 306.

A rectangular press plate 318 corresponding to a unit back shape is arranged inserton a back face of the second unit 106 (on a face at a side counter to a unit front face) slidably to a unit in the directions where a unit is inserted or drown out At an end of the second unit 106, a protrusion 319 having a rectangular parallelepiped shape is formed integrally adjacent to the discharged toner box 314, and the protrusion 319 is slidably covered with an operation member 320. The operation member 320 is formed with an internal space having the same shape as the protrusion 319 having a rectangular parallelepiped shape, and the protrusion 319 is inserted into the internal space.

Figure 4A:
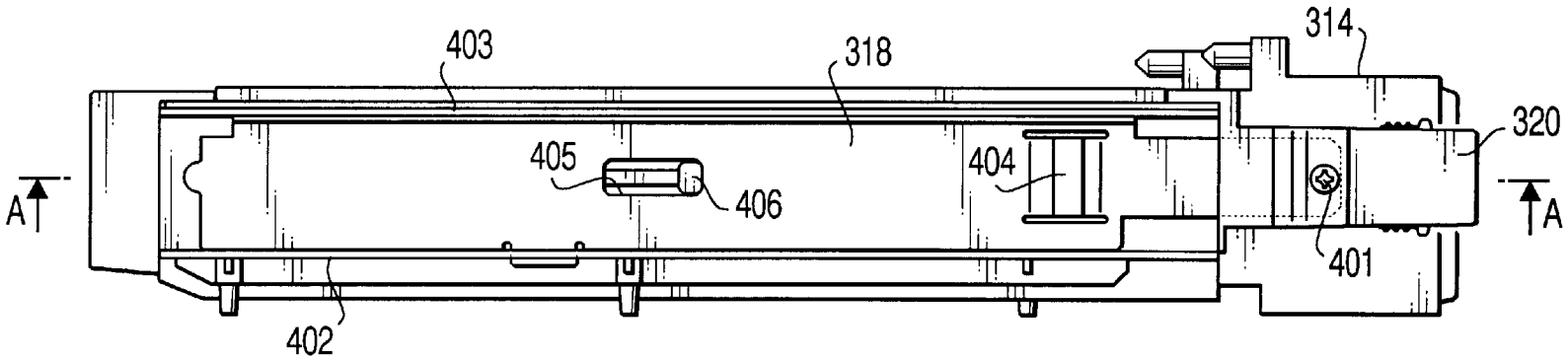
FIG. 4A is an exploded top view of a toner cartridge according to the embodiment of the present invention.
Figure 4B:
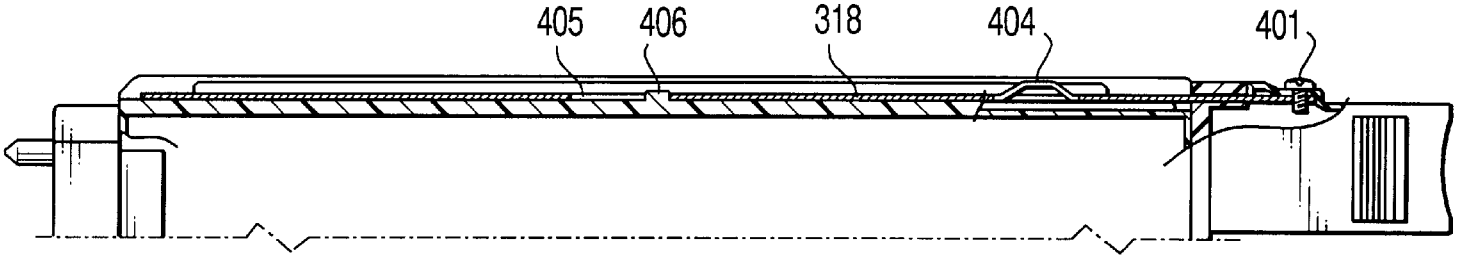
FIG. 4B is a cross-sectional view taken along line A—A of FIG. 4A.

FIG. 4A is a plan view of the second unit 106 as viewed from a back side, and FIG. 4B is a cross-sectional view taken along line A—A of FIG. 4A. One end at a side of the operation member of the press plate 318 is partially overlaid on the back ace of the operation member 320 and is fixed to the operation member 320 with screws 401. A main body art of this press plate 318 is slidably inserted into between a pair of guides 402 and 403 formed along a lower side and upper side on the back face of the second unit. The guides 402, 403 are formed with slide grooves having a slightly greater width than a plate thickness of the press plate 318, respectively, and a lower side and upper side of the press plate 318 are entered into the slide grooves, respectively, whereby it is prevented that the press plate 318 is slipped out to a direction near to a viewer in the drawings.

Furthermore, the press plate 318 is formed with a protrusion 404 projecting outwardly at a position close to the operation member 320 rather than a center part on a back face of the second unit 106. The protrusion 404 is trapezoid-shaped in section. Furthermore, the press plate 318 is formed with a sliding opening part 405 at a position relevant to the center part on the back face. The sliding opening part 405 is rectangular extending long to a move direction of the press plate 318. A long side of the rectangular sliding opening part 405 is set as a dimension relevant to a distance necessary for moving an upper bottom of the protrusion 404 to a press position from a state that the operation member 320 is drawn out as described later. There is a stopper 406 in the sliding opening part 405. The stopper 406 is formed on a back face of the toner box 310. A height of the stopper 406 is set to be in such a height that it projects slightly above an upper face of the press plate 318, with the result that there is no interference with the other parts.

Figure 5:
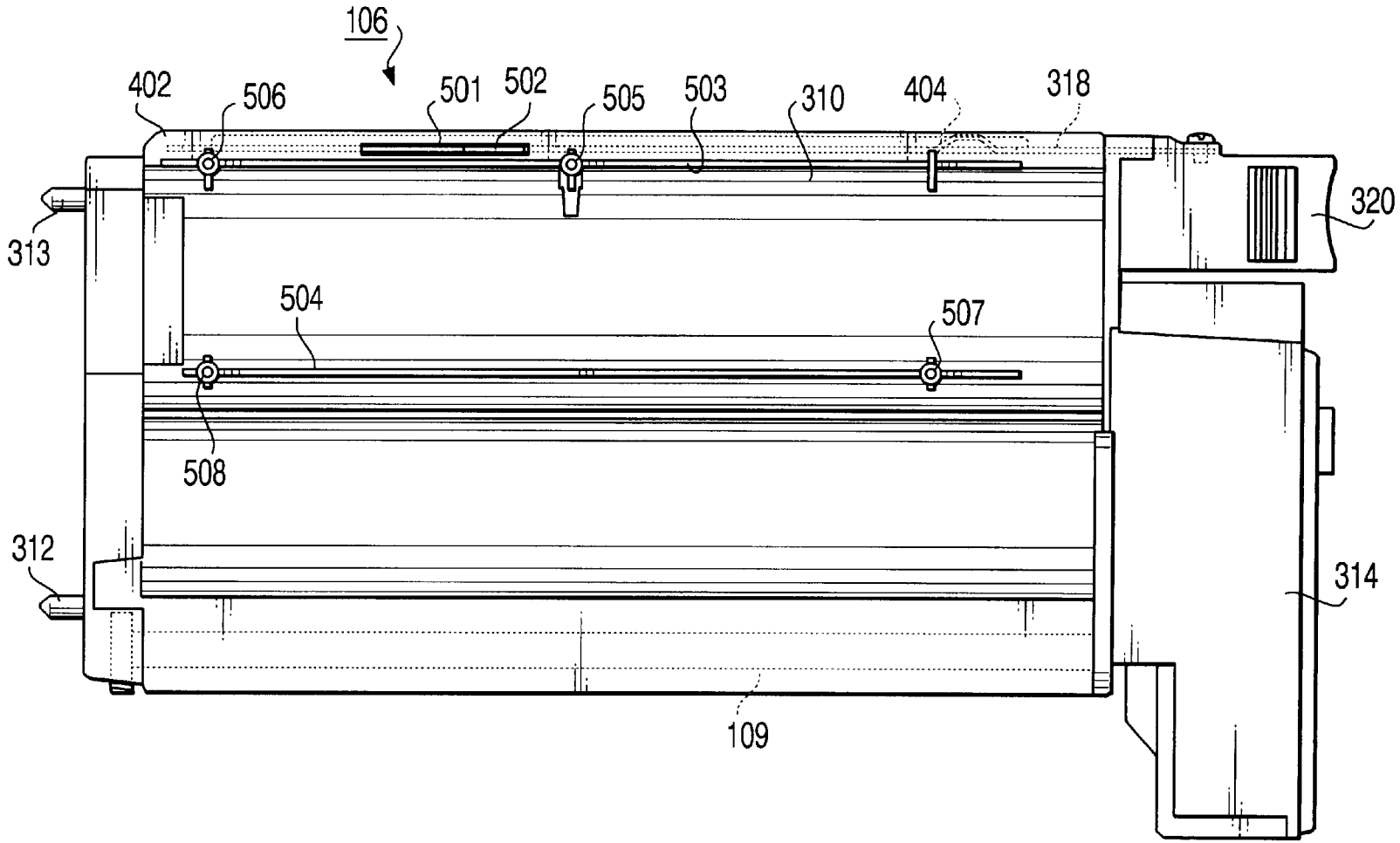
FIG. 5 is a bottom view of the second unit according to the embodiment of the present invention.

FIG. 5 is a plan view of the second unit 106 as viewed from the bottom face. A slit 501 is formed in a part of the guide 402 supporting a lower side of the press plate 318, and a part of the press plate 318 is inserted into the slit as a fitting piece 502. The slit 501 has a sufficient length in the same manner with the sliding opening part 405.

A pair of ribs 503, 504 is formed in parallel on the bottom face of the second unit 106 in the range of one end of the unit and another end thereof spacing a predetermined interval. There are provided column-like projections 505, 506 at two positions in the vicinity of an intermediate part and a front end in the longitudinal direction, respectively. There are provided column-like projections 507, 508 in the vicinity of respective ends in another rib 504, respectively. When the second unit 106 is inserted into or drawn out of the process cartridge accommodation part of the apparatus main body, two guide paths (first and second guide paths) for guiding the four projections 505 to 508 are provided on the bottom face of the process cartridge accommodation part of the apparatus main body.

Figure 6:
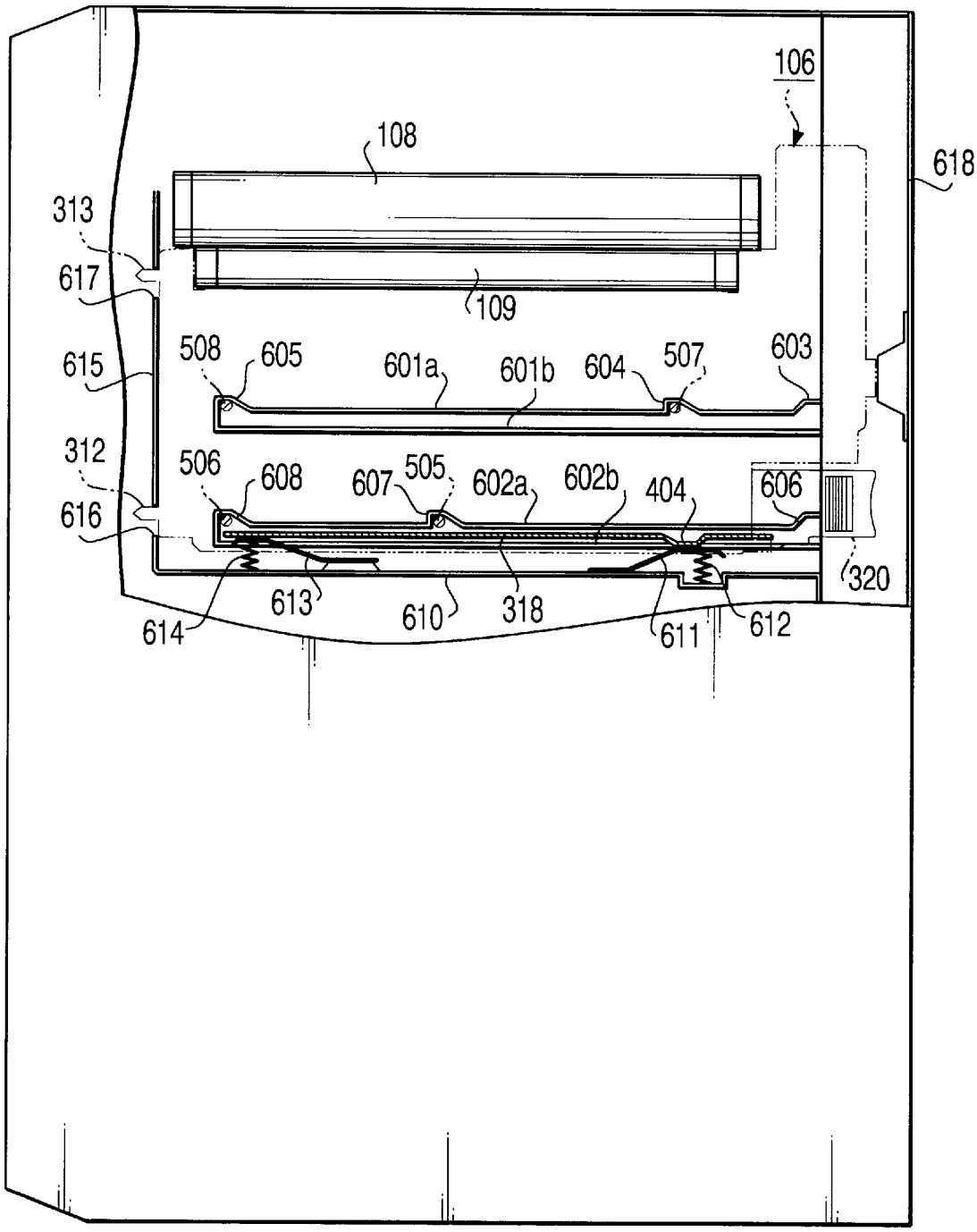
FIG. 6 is a view showing a structure of a bottom face of a process cartridge accommodation part of the image forming apparatus according to the embodiment of the present invention.

FIG. 6 is a view of seeing through the bottom face in the vicinity of the process cartridge accommodation part in a state that the first and second units 105, 106 are attached to the process cartridge accommodation part of the apparatus main body. There is formed a first guide path constituted by a pair of parallel rails 601*a*, 601*b* at a position corresponding to the one rib 504 of the second unit 106 attached on the bottom face of the process cartridge accommodation part. Furthermore, there is formed a second guide path constituted by a pair of parallel rails 602*a*, 602*b* at a position corresponding to the another rib 503 of the second unit 106. The rail 601*a* at a side of the development roller 109 constituting the first guide path is formed with a taper 603 so as to widen a frontage of an inlet of the guide path. Furthermore, the rail 601*a* is formed with recess 604, 605 projecting at a side of the development roller 109 at two positions corresponding to the two projections 507, 508 of the one rib 504 of the second unit 106 attached to the process cartridge accommodation part, respectively. Furthermore, the rail 602*a* at a side of the development roller 109 constituting the second guide path is formed with the taper 603 so as to widen the frontage of the inlet of the guide path. Furthermore, the rail 602*a* is formed with recess 607, 608 projecting at a side of the development roller 109 at two positions corresponding to the two projections 505, 506 provided in the rib 503, respectively.

A side wall 610 forming a part of the process cartridge accommodation part of the apparatus main body is provided confronting the back face of the second unit 106. The side wall 610 is provided with a leaf spring 611 at a position corresponding to the recess 604. The leaf spring 611 has a free end at a position corresponding to the recess 604 and the free end projects up to above the rail 602*b* at a back face side of the unit. A base end-of the free end of the leaf spring 611 is urged to a side of the development roller by a spring 612 fixed to the side wall 610. Furthermore, a leaf spring 613 is provided at a position corresponding to the recess 605 (608) of the side wall 610. The leaf spring 613 has a free end at a position corresponding to the recess 605 and the free end projects to a side of the development roller rather than the rail 602*b* at a back face side of the unit. That is, the free end of the leaf spring 613 at a downmost position is jutted out to a side of the development roller rather than the free end of the leaf spring 611 at a near side.

As shown in FIG. 6, when an insert end of the second unit 106 is in the vicinity of a downmost part of the process cartridge accommodation part, the trapezoid protrusion 404 formed in the press plate 318 comes to a position where it is pressed most by the free end of the leaf spring 611.

Furthermore, the process cartridge accommodation part has a side wall 615 on which the insert end of the second unit 106 abuts. This side wall 615 is formed with the positioning holes 616, 617 into which the protrusions 312, 313 provided at the insert end of the second unit 106 are inserted. Radii of the positioning holes 616, 617 in a direction of the development roller are increased more than diameters of the protrusions 312, 313. As described below, after the insert end of the second unit 106 abuts on the side wall 615, as the second unit 106 moves to a direction of the development roller at a predetermined distance by actions of the press plate 318, a margin therefor is secured.

There is provided an opening/closing door 618 for opening and closing a part confronted to the process cartridge accommodation part in a side wall of the apparatus main body. In a state that the first unit 105 or second unit 106 is not fully inserted into the process cartridge accommodation part, dimensions of the first unit 105 and second unit 106 are set so that the opening/closing door 618 is not closed.

Thus, such a structure is made that, unless in a state that the operation member 320 is fully thrust in, the units are not accommodated in an accommodation space of the process cartridge accommodation part, whereby in the case where the second unit 106 is accommodated in the process cartridge accommodation part, if forgetting to push in the operation member 320, the operation member 320 is in a state of jutting out to the outside of the apparatus main body. Thereby, if a user does not push in the operation member 320, he/she cannot close the opening/closing door 618 of the apparatus main body. As this result, it is possible to reliably prevent such circumstances that, when printing operation is executed in a state that the photosensitive roller 108 and the development roller 109 are not arranged so that a distance therebetween is predetermined, images are printed with deteriorated images.

Next, operations when the above-structured second unit 106 is attached to the process cartridge accommodation part and operations when the second unit 106 attached to the process cartridge accommodation part is detached therefrom will be described by use of FIGS. 7 and 8.

Figure 7:
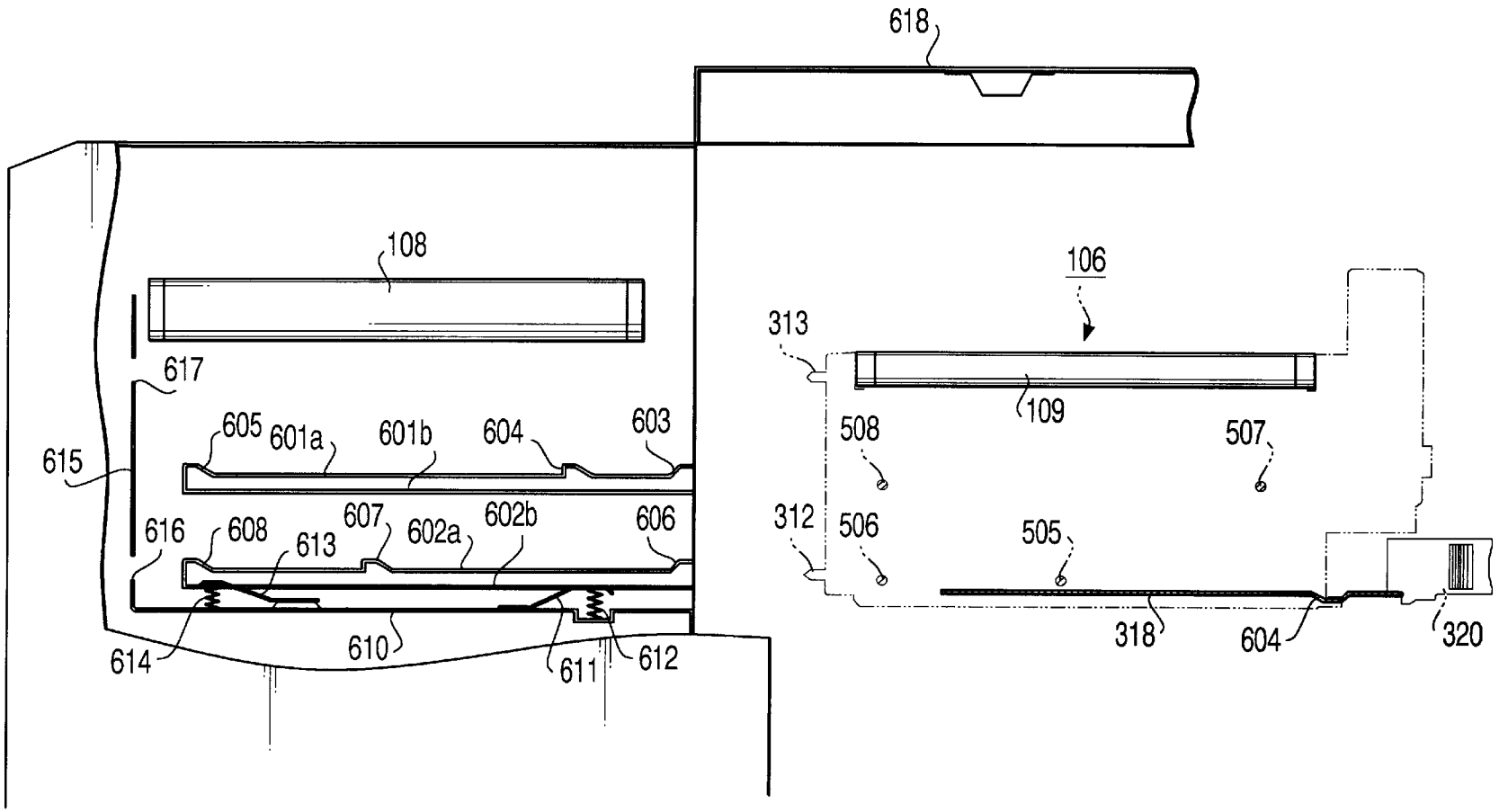
FIG. 7 is a view showing a state that the second unit is inserted into an apparatus main body according to the embodiment of the present invention.

FIG. 7 shows a state that the first unit 105 having the photosensitive roller 108 is inserted into the process cartridge accommodation part, and before the second unit 106 having the development roller 109 is inserted. An opening/closing door 617 is opened in order to insert the second unit 106 into the process cartridge accommodation part. When the opening/closing door 617 is open, the process cartridge accommodation part is in a state as viewed from the outside of the apparatus.

When the second unit 106 is inserted into the process cartridge accommodation part, the press plate 318 is drawn out until one end of the sliding opening part 405 is regulated by the stopper 406. FIG. 7 shows a state that a user grips the operation member 320 and pulls out the press plate 318.

Next, the second unit 106 is thrust in the process cartridge accommodation part as the ribs 504, 503 formed on a lower face of the second unit 106 conform to the first and second guide paths formed on the lower face of the process cartridge accommodation part. At this time, a user grips a part except the operation member 320 in order not to press the operation member 320 and handles the second unit 106. As there is formed a call-in part formed by the tapers 603, 606 at the entries of the first and second guide paths, the projections 508, 506 formed in the ribs 504, 503 can smooth be entered into between the rails 601*a* and 601*b* and between the rails 602*a* and 602*b*.

After the projections 508, 506 are entered into between the rails 601*a* and 601*b* and between the rails 602*a* and 602*b*, as the projections 508, 506 are led by the first and second guide paths, a user only presses the second unit 106 to a horizontal direction, whereby the second unit 106 is thrust in the accommodation part.

Figure 8A:
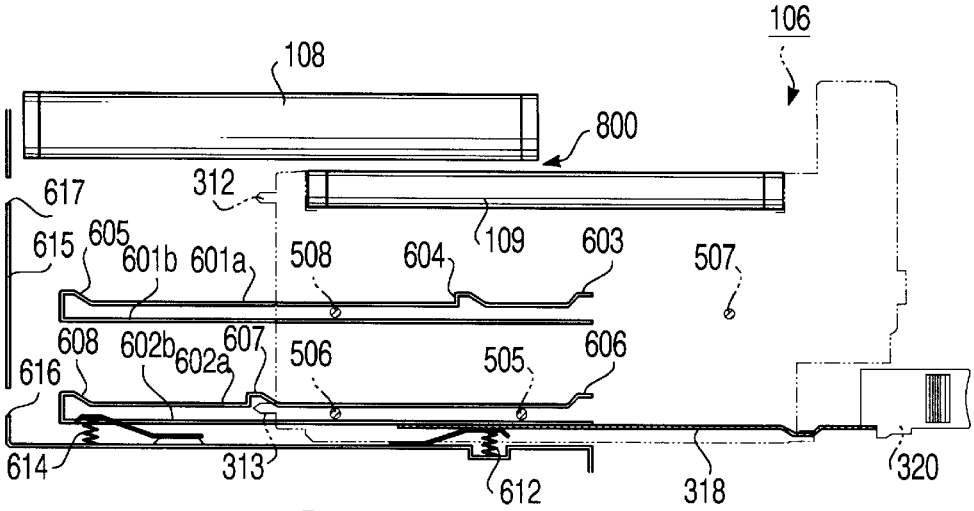
FIG. 8A is a view showing a state that the second unit is halfway inserted into the process cartridge accommodation part according to the embodiment of the present invention.

As shown in FIG. 8A, while the second unit 106 moves along the first and second guide paths, the press plate 318 passes an urging point by the leaf spring 611. However, as the free end of the leaf spring 611 is not projected to a side of the development roller by the rail 602*b* at a side of the unit back face, it is not pressed against the side of the development roller by the leaf spring 611. Moreover, a gap 800 is secured between the photosensitive roller 108 of the first unit 105 inserted previously and the development roller 109 retained by the second unit 106 presently halfway moving along the first and second guide paths.

In this manner, even in the case where the second unit 106 retaining the development roller 109 to come into press contact with the photosensitive roller 108 is inserted into a place to which the first unit 105 retaining the photosensitive roller 108 is inserted, as the second unit 106 is thrust in until downmost in a state that the gap 800 is formed between the photosensitive roller 108 and the development roller 109, it is possible to smoothly insert the second unit 106.

Furthermore, if the second unit 106 moves along the first and second guide paths, the projections 312, 313 at the insert end of the second unit 106 are inserted into the positioning holes 616, 617 formed in the side wall 615 and at positions close to the opposite of the development roller 109, so that the insert end of the second unit 106 abuts on the side wall 615.

Figure 8B:
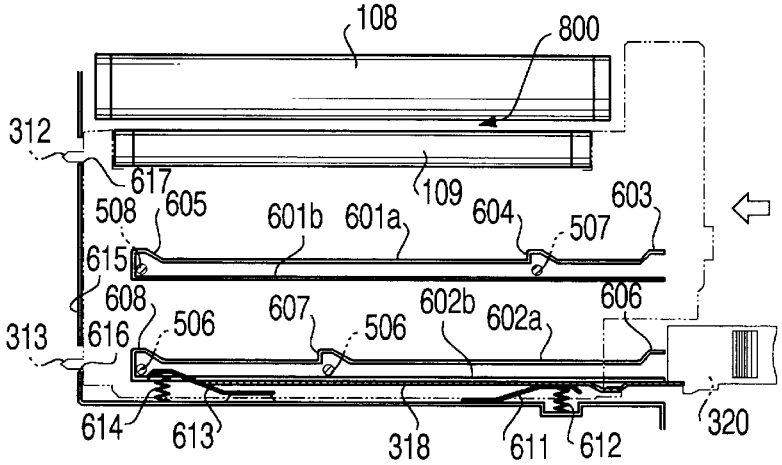
FIG. 8B is a view showing a state immediately after the second unit is inserted into the process cartridge accommodation part according to the embodiment of the present invention.

FIG. 8B shows a state that the insert end of the second unit 106 is thrust in until abutting on the side wall 615. As shown in FIG. 8B, the four projections 505, 506, 507, 508 formed on a lower face of the second unit 106 come to positions of the recess 607, 608, 604, 605 formed in the rails 602*a*, 601*a*, respectively, but are not entered into the recess 607, 608, 604, 605. Since the protrusion 404 of the press plate 318 stops at just this side of the leaf spring 611, and since the front end of the press plate 318 stops at just this side of the leaf spring 613 jutting out to a side of the development roller under the rail 602*b* at a side of the unit back face, the press plate 318 is not pressed against the side of the development roller. In this stage, the gap 800 is also formed between the photosensitive roller 108 and the development roller 109.

In such the state, as the gap 800 is formed between the photosensitive roller 108 and the development roller 109, it cannot be said that an interval between the both is an appropriate distance. According to this embodiment, the pulled-out press plate 318 is thrust in a side of the insert end of the second unit 106, whereby the second unit 106 is pressed against the side of the development roller by the press plate 318, thereby bringing the development roller 109 into press contact with the photosensitive roller 108.

Figure 8C:
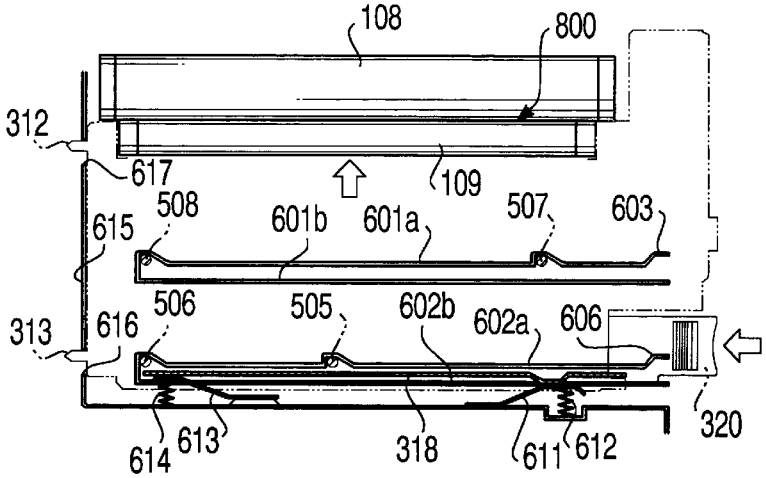
FIG. 8C is a view showing a state that an operation member is thrust in after the second unit is inserted into the process cartridge accommodation part according to the embodiment of the present invention.

That is, in a state shown in FIG. 8B, if a user applies a force moving to a side of the insert end of the second unit 106 on the operation member 320, the press plate 318 fixed to the operation member 320 moves to the same direction as the operation member 320. When the operation member 320 moves, the protrusion 404 provided in the press plate 318 at this side abuts on a free end of the leaf spring 611, and the press plate 318 is pressed against the side of the development roller in proportion to a height relevant to the protrusion 404 by the leaf spring 611. On the other hand, the front end of the press plate 318 abuts on the free end of the leaf spring 613 at a side of the insert end, and the press plate 318 is pressed against the side of the development roller in proportion to a projecting amount of the free end of the leaf spring 613. If the front end of the press plate 318 and the protrusion 404 are pressed against the side of the development roller, as base ends of the leaf springs 611, 613 are fixed to the side wall 610 of the apparatus main body, the second unit 106 itself moves to a side of the development roller. The second unit 106 moving to a side of the development roller stops by abutting the projections 505, 506, 507, 508 formed on the bottom face on the recess 607, 608, 604, 605. At this time, the projections 312, 313 at the unit insert end move to a side of the development roller within the positioning holes 616, 617. FIG. 8C shows a state that the second unit 106 is pressed against the side of the development roller by the press plate 318, so that the development roller 109 is brought into press contact with the photosensitive roller 108.

Thus, the press plate 318 is thrust in by operating the operation member 320, whereby as the second unit 106 is moved to a side of the development roller, thereby bringing the development roller 109 into press contact with the photosensitive roller 108, the second unit 106 is smooth inserted, whereby the photosensitive roller 108 and the development roller 109 can be so set that an interval therebetween is appropriate and desirable image quality can be maintained.

Furthermore, at a position where the insert end of the second unit 106 inserted into the process cartridge accommodation part abuts on the side wall of the process cartridge accommodation part, the projections 505, 506, 507, 508 are confronted to the recess 607, 608, 604, 605, and the second unit 106 is moved towards the first unit 105 by the leaf springs 611, 613 to come into press contact with each other. Thereby, at a position where the first unit 105 is confronted to the second unit 106 having the appropriate correspondence relation, it is possible to hold a distance between the photosensitive roller 108 and the development roller 109 at a predetermined interval, and to confront the photosensitive roller 108 to the development roller 109 with superior precision without misaligning in the longitudinal direction.

Next, operations will be described in the case where only the second unit 106 is fetched out of the first unit 105 and the second unit 106 are accommodated in the process cartridge accommodation part, as shown in FIG. 6. These operations are ones reverse to the operations when the second unit 106 is accommodated in the process cartridge accommodation part.

At first, a user opens the opening/closing door 618, and grips the operation member 320, and pulls it to a pull-out direction in a horizontal direction. When a user draws out the operation member 320 in a direction reverse to one at the time of unit insert, the press plate 318 fixed to the operation member 320 moves. Until the stopper 406 formed on the unit back face abuts on the opening end at a side of the operation member 320 of the sliding opening part 405, only the press plate 318 moves together with the operation member 320. A state that the stopper 406 abuts on the opening end at a side of the operation member 320 of the sliding opening part 405 is one shown in FIG. 8B. When the press plate 318 moves, if the front end of the press plate 318 and the protrusion 404 get rid of an urging point by the leaf springs 613, 611, a force which presses the press plate 318 to a side of the development roller vanishes. At this time, the projections 505, 506, 507, 508 are in the recess 607, 608, 604, 605.

Continuously, if a user pulls the operation member 320 in a pull-out direction, a force in the pull-out direction acts on the second unit 106 via the stopper 406 abutting on the opening end of the sliding opening part 405 of the press plate 318. As the recess 607, 608, 604, 605 are tapered on a side face in the pull-out direction, the projections 505, 506, 507, 508 formed in the second unit 106 smooth get rid of the recess 607, 608, 604, 605 to be drawn out to the first and second guide paths. The photosensitive roller 108 and the development roller 109 which are brought into press contact with each other until then are released from a press contact state at this point of time to again form the gap 800.

Furthermore, if a user pulls the operation member 320 in the pull-out direction, since the press contact state between the photosensitive roller 108 and the development roller 109 has already been released, the second unit 106 is smooth drawn out along the first and second guide paths.

In this manner, a single operation of pulling out the operation member 320 enables to successively perform two operations of the releasing of the press contact state between the photosensitive roller 108 and the development roller 109 and the drawing-out of the second unit 106, so that it can be contrived to enhance operability.

Furthermore, the moving direction of the development roller 109 to the photosensitive roller 108 is different from the moving direction of the operation member 320, but the inserting/drawing out direction of the first and second units 105, 106 is the same with the operating direction of the operation member 320, thereby enhancing operability.

Furthermore, the operation member 320 slidably fitted on the protrusion 319 formed on a side face of the second unit 106 has a sufficient magnitude for gripping it by the palm of a user's hand. On the other hand, the press plate 318 is held between the pair of guides 402, 403 vertically formed on the back face of the second unit 106, and also the press plate 318 is structured so as not to slip out by the stopper 406. Thereby, such a mechanical strength is realized that, even after the second unit 106 is fully slipped out from the process cartridge accommodation part, the second unit 106 can be handled only by the operation member 320. Accordingly, a single operation of pulling the operation member 320 allows to fully fetch out the second unit 106 from the process cartridge accommodation part.

The present invention is not limited to the above described embodiments, and various variations and modifications may be possible without departing from the scope of the present invention.

This application is based on the Japanese Patent Application No. 2000-031352 filed on Feb. 9, 2000, entire content of which is expressly incorporated by reference herein.

What is claimed is:

1. A process cartridge which has a first unit including a photoreceptor and a second unit including a development roller which confronts the photoreceptor, the first unit and the second unit having a separable structure, said process cartridge comprising:

an operation member provided at an end of the second unit and configured to move in a direction such that the second unit is mountable on or dismountable from the first unit; and a pressing member provided in the second unit, said pressing member pressing the second unit against the first unit when said operation member moves in a direction such that the second unit is mounted on the first unit, and releasing the pressing of the second unit against the first unit when said operation member moves in a direction such that the second unit is dismounted from the first unit, wherein said operation member serves to pull out the entirety of the second unit from an apparatus when the second unit moves in the direction such that the second unit is dismounted from the first unit.

2. A process cartridge which has a first unit including a photoreceptor and a second unit including a development roller which confronts the photoreceptor, the first unit and the second unit having a separable structure, the process cartridge comprising:

an operation member provided at an end of the second unit and configured to move in a direction such that the second unit is mountable on or dismountable from the first unit; and a pressing member provided in the second unit, said pressing member pressing the second unit against the first unit when said operation member moves in a direction such that the second unit is mounted on the first unit, and releasing the pressing of the second unit against the first unit when said operation member moves in a direction such that the second unit is dismounted from the first unit, wherein the direction of movement of said operation member is orthogonal to the direction of pressing by said pressing member.

3. The process cartridge according to claim 2, wherein the first unit includes a toner accommodation section for accommodating toner therein.

4. The process cartridge according to claim 2, wherein the photoreceptor comprises a photoreceptor roller.

5. An image forming apparatus comprising:

a process cartridge that has a first unit including a photoreceptor and a second unit including a development roller, the first unit and the second unit having a separable structure;

an accommodation portion that accommodates said process cartridge therein; and a first pressing member provided in said accommodation portion, said process cartridge comprising:

an operation member provided at an end of the second unit and configured to move in a direction such that the second unit is mountable on or dismountable from the first unit; and a second pressing member provided in the second unit, said second pressing member cooperating with said first pressing member to press the second unit against the first unit by a pressing force of said first pressing member when said operation member moves in a direction such that the second unit is mounted on the first unit, and to release the pressing of the second unit against the first unit when said operation member moves in a direction such that the second unit is dismounted from the first unit, wherein said operation member serves to pull out the entirety of the second unit from the apparatus when the second unit moves in a direction such that the second unit is dismounted from the first unit.

6. The image forming apparatus according to claim 5, wherein the direction of movement of said operation member is orthogonal to the direction of pressing by said second pressing member.

7. An image forming apparatus comprising:

a process cartridge that has a first unit including a photoreceptor and a second unit including a development roller, the first unit and the second unit having a separable structure;

an accommodation portion that accommodates said process cartridge therein; and a first pressing member provided in said accommodation portion, said process cartridge comprising:

an operation member provided at an end of the second unit and configured to move in a direction such that the second unit is mountable on or dismountable from the first unit, and a second pressing member provided in the second unit, said second pressing member cooperating with said first pressing member to press the second unit against the first unit by a pressing force of said first pressing member when said operation member moves in a direction such that the second unit is mounted on the first unit, and to release the pressing of the second unit against the first unit when said operation member moves in a direction such that the second unit is dismounted from the first unit, wherein the direction of movement of said operation member is orthogonal to the direction of pressing by said first pressing member and by said second pressing member.

8. An image forming apparatus comprising:

a process cartridge that has a first unit including a photoreceptor and a second unit including a development roller, the first unit and the second unit having a separable structure;

an accommodation portion that accommodates said process cartridge therein;

a first pressing member provided in said accommodation part; and a rail provided on the bottom of said accommodation part and having a recess positioned opposite to said first pressing member at a location corresponding to said first pressing member, said process cartridge comprising:

an operation member provided at an end of the second unit and capable of moving in a direction such that the second unit is mountable on or dismountable from the first unit;

a protrusion provided at a location corresponding to the recess of said rail and guided by said rail so that the second unit is mounted on the first unit when said protrusion enters into the recess;

a second pressing member provided in the second unit, said second pressing member cooperating with said first pressing member to press the second unit against the first unit and to engage said protrusion with the recess by a pressing force of said first pressing member when said operation member moves in a direction such that the second unit is mounted on the first unit, said second pressing member cooperating with said first pressing member to release pressing of the second unit against the first unit and disengage said protrusion from the recess when said operation member is moved in a direction such that the second unit is dismounted from the first unit.

* * * * *